US008901817B2

(12) United States Patent
Yao et al.

(10) Patent No.: US 8,901,817 B2
(45) Date of Patent: Dec. 2, 2014

(54) METAL HALIDE LAMP WITH CERAMIC DISCHARGE TUBE

(75) Inventors: Hua Yao, Shanghai (CN); Feng Li, Shanghai (CN)

(73) Assignee: Shanghai Yaming Lighting Co., Ltd., Shanghai (CN)

( * ) Notice: Subject to any disclaimer, the term of this patent is extended or adjusted under 35 U.S.C. 154(b) by 0 days.

(21) Appl. No.: 13/704,983

(22) PCT Filed: Nov. 25, 2010

(86) PCT No.: PCT/CN2010/079129

§ 371 (c)(1),
(2), (4) Date: Dec. 17, 2012

(87) PCT Pub. No.: WO2011/160394

PCT Pub. Date: Dec. 29, 2011

(65) Prior Publication Data

US 2013/0099662 A1 Apr. 25, 2013

(30) Foreign Application Priority Data

Jun. 24, 2010 (CN) ..... 2010 1 0209379

(51) Int. Cl.

| | |
|---|---|
| ***H01J 61/33*** | (2006.01) |
| ***H01J 61/12*** | (2006.01) |
| ***H01J 61/34*** | (2006.01) |
| ***H01J 61/82*** | (2006.01) |

(52) U.S. Cl.

CPC ..... *H01J 61/33* (2013.01); *H01J 61/125* (2013.01); *H01J 61/34* (2013.01); *H01J 61/827* (2013.01)

USPC ..... 313/620; 313/573; 313/634; 313/638; 313/640

(58) Field of Classification Search

USPC ..... 313/493, 573, 634, 638, 640

See application file for complete search history.

(56) References Cited

U.S. PATENT DOCUMENTS

| | | | | |
|---|---|---|---|---|
| 4,503,356 | A * | 3/1985 | Kobayashi et al. | 313/634 |
| 6,215,254 | B1 * | 4/2001 | Honda et al. | 315/246 |
| 2006/0119274 | A1 * | 6/2006 | Dakin et al. | 315/56 |
| 2012/0169224 | A1 * | 7/2012 | Welter | 313/573 |

FOREIGN PATENT DOCUMENTS

| | | | |
|---|---|---|---|
| CN | 1182276 | * | 5/1998 |
| CN | 1246200 | * | 3/2000 |
| CN | 101436516 | * | 5/2009 |
| CN | 101663728 | * | 3/2010 |

* cited by examiner

*Primary Examiner* — Ashok Patel

(74) *Attorney, Agent, or Firm* — Tianhua Gu; Global IP Services

(57) ABSTRACT

The present invention relates to a metal halide lamp with a ceramic discharge tube, which includes a ceramic discharge tube and two electrodes. The ceramic discharge tube includes a main discharge tube and two ceramic capillary tubes respectively located at two ends of the main discharge tube, the main discharge tube has a central protuberant part located in the middle thereof and two cylindrical parts respectively connected to two ends of the central protuberant part, the two cylindrical parts are respectively connected to the two ceramic capillary tubes. The shape of the ceramic discharge tube may, under the premise of maintaining high efficacy, effectively reduce the highest temperature in the center of the tube body, thereby greatly enhancing lamp reliability, and meanwhile with such structure, a fixed cold spot is also formed at a lower end of a discharge cavity formed at central protuberant part, so that a filler may always be fixedly deposited at the cold spot; in this way, the stability of the color temperature of the metal halide lamp with a ceramic discharge tube may be effectively improved.

13 Claims, 3 Drawing Sheets

METAL HALIDE LAMP WITH CERAMIC DISCHARGE TUBE

CROSS REFERENCE TO RELATED PATENT APPLICATION

The present application is the US national stage of PCT/CN2010/079129 filed on Nov. 25, 2010, which claims the priority of the Chinese patent application No. 201010209379.9 filed on Jun. 24, 2010, which application is incorporated herein by reference.

BACKGROUND OF THE PRESENT INVENTION

1. Field of Invention

The present invention relates to a metal halide lamp, and more specifically to a horizontally lighted metal halide lamp with a ceramic discharge tube with high efficacy.

2. Description of Related Arts

A metal halide lamp with a ceramic discharge tube has been widely used. For an ordinary metal halide lamp with a ceramic discharge tube, a discharge cavity is formed in the ceramic discharge tube, the discharge cavity is filled with inert gas (such as xenon Xe) and ionizable salt, a pair of electrodes placed in the discharge cavity are located at two ends of the ceramic discharge tube respectively, a certain interval exists between tips of the two electrodes so as to form a discharge path there-between. Currently, no matter whether the ceramic discharge tube of the ordinary ceramic metal halide lamp is of a one-body type, two-body type, three-body type, or even five-body type in early time, the geometric shape of the appearance of the ceramic tube body has a common characteristic: the ceramic discharge tube is always formed of three parts, that is, a fat cylinder or ellipsoid (as shown in FIG. 2) of a middle discharge part (as shown in FIG. 1) and two co-axial thin cylinders at two sides.

To increase the light emitting efficiency of the metal halide lamp with a ceramic discharge tube, currently the metal halide lamp with a ceramic discharge tube with high efficacy is designed with a structure as shown in FIG. 3, in which the ceramic discharge tube usually adopts a slender ceramic tube body, and such slender ceramic tube body is characterized in that the maximum inner diameter D1 in the center is less than the distance L1 between the electrodes. Although the ceramic discharge tube adopting such mechanism may achieve high efficacy certain disadvantages also exist. Firstly, such slender ceramic tube body is small in the inner diameter, and is large in the tube wall load, and when the slender ceramic tube body is horizontally lighted, arc bending makes the temperature of the central part at the upper end of the tube wall excessively high, thereby causing deformation of the tube wall of the ceramic tube body, or even fracture, so as to seriously influence product reliability and safety.

In addition to the disadvantage that the excessively high temperature in the center of the upper end of the tube wall causes deformation or fracture of the tube wall of the ceramic tube body, another prominent problem of the ceramic discharge tube in such slender design is: the tube body is slender, the "cold spot" is located at the two ends, which is far away from the center of the arc when the tube body is horizontally lighted, and the position of the "cold spot" is not fixed, so the filler in the ceramic discharge tube has no fixed condensation point, thereby causing the color temperature to be unstable, so that the color temperatures variation among lamps is great, and the color temperature of a single lamp drifts significantly with time, so as to seriously influence the illumination quality of the lamp.

Furthermore, currently, the filler in the usually used metal halide lamp is generally metal halide series containing rare earth metal such as $DyI_3$, $HoI_3$, and $TmI_3$. These metal halides may enable a lamp to have excellent color rendering properties, but these metal halides have very strong corrosivity at high temperature, so these metal halides are not appropriate candidates to be used in a high efficacy ceramic metal halide lamp efficacy.

SUMMARY OF THE PRESENT INVENTION

With respect to deficiency in the prior art, a technical problem to be solved by the present invention is to provide a metal halide lamp with a ceramic discharge tube, so as to effectively cope with the influence of the arc bending on an arc tube wall, reduce the highest temperature of the upper end in the middle of the tube wall at the time of horizontal lighting, and reduce the temperature difference on the entire ceramic tube body under the premise of ensuring high efficacy.

To solve the foregoing technical problem, the present invention adopts the following technical scheme:

A metal halide lamp with a ceramic discharge tube comprises a ceramic discharge tube and two electrodes, a discharge cavity is formed in the ceramic discharge tube, a filler is disposed in the discharge cavity, the ceramic discharge tube comprises a main discharge tube and two ceramic capillary tubes located at the two ends of the main discharge tube respectively, the two electrodes are inserted into the two ceramic capillary tubes respectively and extend into the discharge cavity, the two electrodes are opposite to each other, outer ends of the two ceramic capillary tubes are sealed, the main discharge tube has a central protuberant part located in the middle thereof and two cylindrical parts respectively connected to two ends of the central protuberant part, the two cylindrical parts are respectively connected to the two ceramic capillary tubes, the inner diameter of the central protuberant part is greater than the inner diameter of the cylindrical part, and the distance between the two electrodes is greater than the maximum inner diameter of the central protuberant part.

Preferably, the distance A between two outer end faces of the central protuberant part, the distance B between two outer end faces of the main discharge tube, the inner diameter C of the ceramic capillary tube, the inner diameter D of the cylindrical part, the maximum inner diameter E of the central protuberant part, and the distance L between the two electrodes satisfy the following relations: $0.2<A: B<1$, $0.3<D: E<1$, and $0.2<E: L<1$.

Preferably, $0.3<A: B<1$, $0.4<D: E<0.6$, and $0.3<E: L<0.6$.

Preferably, the central protuberant part is in a shape of sphere, ellipsoid or partial ellipsoid.

Preferably, the filler comprises NaI and a halide X, and the halide X is one or more of $LaI_3$, $CeI_3$ and $PrI_3$, in which a mole ratio of NaI/X is between 4 and 18.

Further, the mole ratio of NaI/X is between 5 and 16.

Further, the mole ratio of NaI/X is between 6 and 14.

Preferably, the halide X is a mixture of $PrI_3$ and $LaI_3$, in which a mole ratio of $PrI_3/LaI_3$ is between 0.2 and 2.

Preferably, the halide X is a mixture of $PrI_3$, $LaI_3$ and $CeI_3$.

Preferably, the filler further comprises TlI or $CaI_2$.

The foregoing technical scheme has the following beneficial effects: in the metal halide lamp, the central protuberant part is disposed in the middle of the ceramic discharge tube, and the discharge cavity formed in the ceramic discharge tube is protuberant outward in the middle, so that the tube wall in the middle of the ceramic discharge tube is far away from the arc generated through discharge of the two electrodes; in this way, even if the arc bending warps upward, the temperature of the tube wall in the middle of the ceramic discharge tube is not excessively high, so as to effectively prevent fracture of the ceramic discharge tube. Meanwhile, with such structure, a fixed cold spot is formed at the lower end of the discharge cavity formed in the central protuberant part, so that the filler may always be fixedly deposited at the cold spot, and in this way, the stability of the color temperature of the metal halide lamp with a ceramic discharge tube may be effectively improved. Furthermore, the filler of the metal halide lamp with a ceramic discharge tube does not generate strong corrosivity at high temperature, and the metal halide lamp may provide white light with efficacy higher than 110 LPW, and meanwhile has good color rendering properties and stable color temperature.

DETAILED DESCRIPTION OF THE PREFERRED EMBODIMENTS

Preferable implementation cases of the present invention are introduced in detail below with reference to accompanying drawings.

Figure 1:
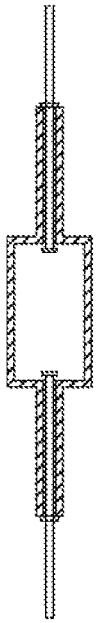
FIG. 1 Prior Art
FIG. 1 is a schematic diagram of a shape of a ceramic discharge tube of a conventional cylindrical metal halide lamp with a ceramic discharge tube.
Figure 2:
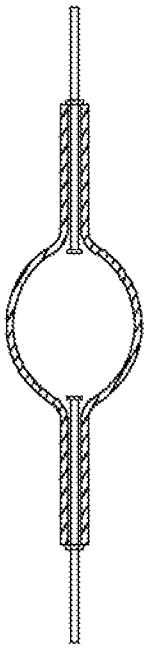
FIG. 2 Prior Art
FIG. 2 is a schematic diagram of a shape of a ceramic discharge tube of a conventional ellipsoidal metal halide lamp with a ceramic discharge tube.
Figure 3:
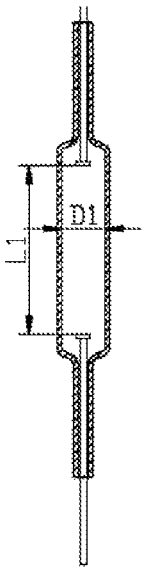
FIG. 3 Prior Art
FIG. 3 is a schematic diagram of a shape of a ceramic discharge tube of a conventional slender metal halide lamp with a ceramic discharge tube.
Figure 4:
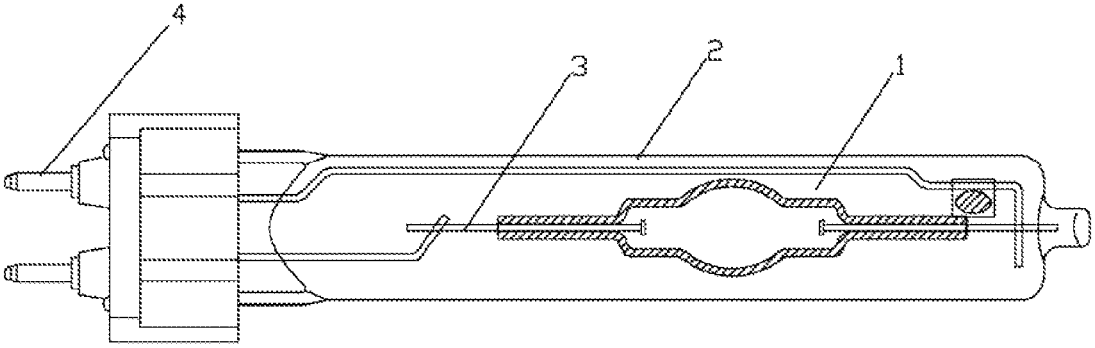
FIG. 4 is a schematic diagram of a structure of a metal halide lamp consistent with the present invention.

As shown in FIG. 4, the metal halide lamp includes a quartz tube 2, a ceramic discharge tube 1 is disposed in the quartz tube 2, a discharge cavity is formed in the ceramic discharge tube, and a filler is disposed in the discharge cavity. An electrode 3 is disposed at each of two ends of the ceramic discharge tube 1, the two electrodes 3 are inserted into the discharge cavity formed in the ceramic discharge tube 1 from two ends respectively, the two electrodes 3 are opposite, and outer ends of the two electrodes 3 are respectively connected to two outer electrodes 4 on the quartz tube 2. The two outer electrodes 4 are connected to a power supply to make the two electrodes 3 be power-on, and discharging occurs between the two electrodes 3 to generate an arc to emit light.

Figure 5:
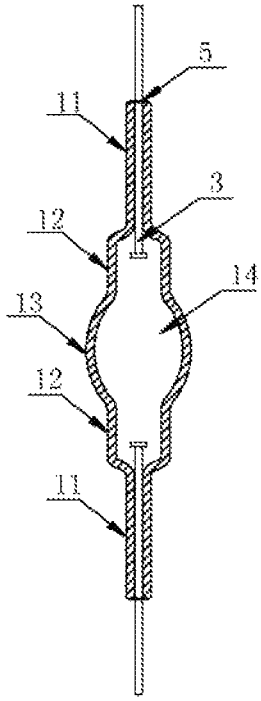
FIG. 5 is a schematic diagram of a shape of a ceramic discharge tube of a metal halide lamp with a ceramic discharge tube consistent with the present invention.

As shown in FIG. 5, the ceramic discharge tube 1 includes a main discharge tube and two ceramic capillary tubes 11 respectively located at two ends of the main discharge tube, the two electrodes 3 respectively run through the two ceramic capillary tubes 11 and extend into the discharge cavity 14, the two electrodes 3 are opposite to each other, and outer ends of the two ceramic capillary tubes are sealed through a sealing solder 5. The main discharge tube includes a central protuberant part 13 located in the middle and two cylindrical parts 12 respectively connected to two ends of the central protuberant part 13, and the two cylindrical parts 12 are respectively connected to the two ceramic capillary tubes 11. The central protuberant part 13 may be in a shape of sphere, ellipsoid or partial ellipsoid, the inner diameter of the central protuberant part 13 is greater than the inner diameter of the cylindrical part 12, and the distance between the two electrodes 3 is greater than the maximum inner diameter of the central protuberant part 13.

Figure 6:
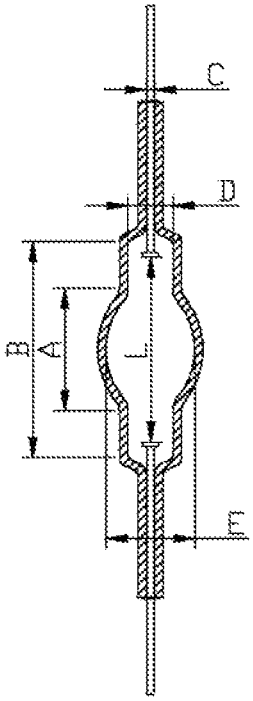
FIG. 6 is a schematic diagram of a dimension proportion of a ceramic discharge tube of a metal halide lamp with a ceramic discharge tube consistent with the present invention.

As shown in FIG. 6, the distance between two outer end faces of the central protuberant part is marked as A, the distance between two outer end faces of the main discharge tube is marked as B, the inner diameter of the ceramic capillary tube is marked as C, the inner diameter of the cylindrical part is marked as D, the maximum inner diameter of the central protuberant part is marked as E, the distance between the two electrodes is marked as L, and the foregoing parameters should satisfy the following relational expressions: $0.2<A:B<1$, $0.3<D:E<1$, and $0.2<E:L<1$. Preferably, $0.3<A:B<1$, $0.4<D:E<0.6$, and $0.3<E:L<0.6$.

In the metal halide lamp, the central protuberant part is disposed in the middle of the ceramic discharge tube, and the discharge cavity formed in the ceramic discharge tube is protuberant outward in the middle, so that the tube wall in the middle of the ceramic discharge tube is far away from the arc generated through discharge of the two electrodes; in this way, even if the arc bending warps upward, the temperature of the tube wall in the middle of the ceramic discharge tube is not excessively high, so as to effectively prevent fracture of the ceramic discharge tube. The following table shows comparison between two implementation cases of the present invention and a currently conventional efficient metal halide lamp:

| | Power | A:B | D:E | E:L | Highest temperature in the center of the upper end of the tube wall during horizontal lighting |
|---|---|---|---|---|---|
| Case 1 | 140 W | 0.48 | 0.53 | 0.4 | 1180° C. |
| Case 2 | 140 W | 0.9 | 0.53 | 0.4 | 1160° C. |
| Comparison with the conventional design | 140 W | 1 | 1 | 0.2 | 1320° C. |

It can be known from the above table that, the metal halide lamp in the structure may be adopted to achieve the objective of effectively reducing the temperature of the middle tube wall of the ceramic discharge tube. Accordingly, it can be seen that, the shape of the ceramic discharge tube of the present invention may, under the premise of maintaining high efficacy, effectively reduce the highest temperature in the center of the tube body, thereby greatly enhancing lamp reliability. Meanwhile, with such structure, a fixed cold spot is formed at the lower end of the discharge cavity formed in the central protuberant part, so that the filler may always be fixedly deposited at the cold spot; in this way, the stability of the color temperature of the metal halide lamp with a ceramic discharge tube may be effectively improved.

The present invention further discloses a filler of the metal halide lamp. The filler includes NaI and a halide X formed of one or more of $LaI_3$, $CeI_3$ and $PrI_3$, in which the mole ratio of NaI/X is between 4 and 18; preferably, the mole ratio of NaI/X is between 5 and 16; further preferably, the mole ratio of NaI/X may be between 6 and 14. Preferably, the halide X may be a mixture of $PrI_3$ and $LaI_3$, in which a mole ratio of $PrI_3/LaI_3$ is between 0.2 and 2, and the halide X may also be a mixture of $PrI_3$, $LaI_3$ and $CeI_3$.

The filler does not generate strong corrosivity at high temperature, and is appropriate to be used in a ceramic metal halide lamp with high efficacy, and the ceramic metal halide lamp may provide white light with high efficacy higher than 110 LPW, whose color rendering index CRI is higher than 70, and has good color rendering properties and stable color temperature. Furthermore, TlI may be added into the filler in order to further increase the efficacy of the metal halide lamp, and $CaI_2$ may be added into the filler in order to further improve the rendered color of the metal halide lamp. Optimally, xenon is selected as the buffer gas of the metal halide lamp, so as to increase the efficacy and increase the luminous flux maintenance factor.

The metal halide lamp with a ceramic discharge tube provided according to the implementation cases of the present invention is introduced in detail in the previous description. Persons having ordinary skill in the art can make variations and modifications to the present invention in terms of the specific implementation manners and application scopes according to the ideas of the implementation cases of the present invention. To sum up, the specification shall not be construed as limitations to the present invention. Any change made according to the design idea of the present invention falls within the protection scope of the present invention.

What is claimed is:

1. A metal halide lamp with a ceramic discharge tube comprising:

a ceramic discharge tube having a discharge cavity and two electrodes, a filler is disposed in the discharge cavity;

the ceramic discharge tube is structured as a main discharge tube having two ceramic capillary tubes respectively located at two ends of the main discharge tube, the two electrodes are respectively enwrap in the two ceramic capillary tubes and extend into the discharge cavity being opposite to each other, outer ends of the two ceramic capillary tubes are sealed;

the main discharge tube has a central protuberant part located in middle thereof and two cylindrical parts respectively connected to two ends of the central protuberant part, thereby the discharge cavity formed has a central protuberant part together with two cylindrical parts at two ends respectively, the two electrodes are respectively disposed in inner cavities of the two cylindrical parts, the two cylindrical parts are respectively connected to the two ceramic capillary tubes;

an inner diameter of the central protuberant part is larger than the inner diameter of the cylindrical part, and the distance between the two electrodes is larger than a maximum inner diameter of the central protuberant part;

a distance A between two ends of the central protuberant part, a distance B between two ends of the main discharge tube, an inner diameter C of the ceramic capillary tube, an inner diameter D of the cylindrical part, a maximum inner diameter E of the central protuberant part, and a distance L between the two heads of the electrodes satisfy the following relations: $0.2<A:B<1$, $0.3<D:E<1$, and $0.2<E:L<1$.

2. The metal halide lamp with a ceramic discharge tube as in claim 1, characterized in that, $0.3<A:B<1$, $0.4<D:E<0.6$, and $0.3<E:L<0.6$.

3. The metal halide lamp with a ceramic discharge tube as in claim 1, characterized in that, the central protuberant part is in a shape of sphere, ellipsoid or partial ellipsoid.

4. The metal halide lamp with a ceramic discharge tube as in claim 3, characterized in that, the filler further comprises TlI or $CaI_2$.

5. The metal halide lamp with a ceramic discharge tube as in claim 1, characterized in that, the filler comprises NaI and a halide X, the halide X is one or more of $LaI_3$, $CeI_3$ and $PrI_3$, wherein a mole ratio of NaI/X is between 4 and 18.

6. The metal halide lamp with a ceramic discharge tube as in claim 5, characterized in that, the mole ratio of NaI/X is between 5 and 16.

7. The metal halide lamp with a ceramic discharge tube as in claim 6, characterized in that, the mole ratio of NaI/X is between 6 and 14.

8. The metal halide lamp with a ceramic discharge tube as in claim 7, characterized in that, the halide X is a mixture of $PrI_3$ and $LaI_3$, wherein a mole ratio of $PrI_3/LaI_3$ is between 0.2 and 2.

9. The metal halide lamp with a ceramic discharge tube as in claim 5, characterized in that, the halide X is a mixture of $PrI_3$ and $LaI_3$, wherein a mole ratio of $PrI_3/LaI_3$ is between 0.2 and 2.

10. The metal halide lamp with a ceramic discharge tube as in claim 5, characterized in that, the halide X is a mixture of $PrI_3$, $LaI_3$ and $CeI_3$.

11. The metal halide lamp with a ceramic discharge tube as in claim 6, characterized in that, the halide X is a mixture of $PrI_3$ and $LaI_3$, wherein a mole ratio of $PrI_3/LaI_3$ is between 0.2 and 2.

12. The metal halide lamp with a ceramic discharge tube as in claim 6, characterized in that, the halide X is a mixture of $PrI_3$, $LaI_3$ and $CeI_3$.

13. The metal halide lamp with a ceramic discharge tube as in claim 7, characterized in that, the halide X is a mixture of $PrI_3$, $LaI_3$ and $CeI_3$.

* * * * *